United States Patent [19]

Ritchie

[11] Patent Number: 4,693,613

[45] Date of Patent: Sep. 15, 1987

[54] LOGO CLOCK

[75] Inventor: Douglas Ritchie, Stowe, Mass.

[73] Assignee: By Design Corp., Cambridge, Mass.

[21] Appl. No.: 824,743

[22] Filed: Jan. 31, 1986

[51] Int. Cl.[4] ..... G04B 19/04

[52] U.S. Cl. ..... 368/238; 368/223; 368/228

[58] Field of Search ..... 368/223–238, 368/276, 327, 62

[56] References Cited

U.S. PATENT DOCUMENTS 2,536,206 1/1951 Newhouse ..... 368/238

FOREIGN PATENT DOCUMENTS 827771 1/1952 Fed. Rep. of Germany ..... 368/238

1249773 9/1967 Fed. Rep. of Germany ..... 368/238

1139119 6/1957 France ..... 368/238

282774 8/1952 Switzerland ..... 368/238

324250 8/1957 Switzerland ..... 368/238

*Primary Examiner*—Bernard Roskoski

*Attorney, Agent, or Firm*—Wolf, Greenfield & Sacks

[57] ABSTRACT

A clock having an hour housing supporting an integral hour hand and a minute housing supporting an integral minute hand along with a timing mechanism supported within the hour housing and having hour and minute driven shafts coupling to the respective hour and minute housings. There is provided a logo disk at the front of the clock which is maintained in a stationery position relative to the adjacent rotating minute housing. A support bracket is used for supporting the timing mechanism from a wall or the like.

21 Claims, 8 Drawing Figures

LOGO CLOCK

BACKGROUND AND SUMMARY OF THE INVENTION

The present invention relates in general to a clock and pertains, more particularly, to a battery operated clock that is of relatively simple construction and that has an extremely esthetic appearance. Moreover, the present invention relates to an improved clock construction having a front logo plate or the like associated with the rotating clock hands, but that is maintained in a stationary position.

It is an object of the present invention to provide a simplified clock construction and one in which the time is indicated without time numerals primarily by virtue of hand position of the clock hands.

Another object of the present invention is to provide an improved clock in which the hands are each integral with a support housing.

Still a further object of the present invention is to provide an improved clock construction in which the components are few, the construction is simple, and the assembly of the clock can be carried out quite readily.

Still a further object of the present invention is to provide an improved clock construction having minute and hour housings each with associated integral hands and further including means for supporting a logo or other indicia in a stationary position at the center of the clock.

To accomplish the foregoing and other objects, features and advantages of the invention, there is provided a clock having an hour housing supporting an hour hand integral therewith and also a minute housing for correspondingly supporting a minute hand integral therewith. A timing mechanism is provided supported in one of the housings at the rear of the clock. In the preferred embodiment described herein, the timing mechanism is battery operated and is supported in the hour housing. The timing mechanism has an hour driven shaft coupled to the hour housing and in turn the hour hand. Also, the timing mechanism has a minute driven shaft coupled to the minute housing for rotatably driving the minute housing and in turn the minute hand. Means are provided at the front of the clock for carrying indicia which may be in the form of a slogan, saying, picture, or logo or the like. Means are provided for maintaining the indicia carrying means in a stationary position relative to the adjacent rotating other housing. Again, in a preferred embodiment, the other housing is the minute housing which is disposed forward of the hour housing with the indicia carrying means disposed preferably forwardly of the minute housing. Means are provided for supporting the timing mechanism in a fixed position with the output shafts thereof providing for driving of the corresponding hour and minute housings and respective hands. In accordance with the invention, there is preferably provided a counterweight disposed inside of the minute housing along a peripheral side opposite to the minute hand so as to provide proper balance for the minute housing so as not to put undue strain upon the timing mechanism. The means for maintaining the indicia carrying means in a stationary position also preferably includes a second counterweight. In a preferred embodiment of the invention, the indicia carrying means is supported from the minute driven shaft. The means for supporting the indicia carrying means includes means for supporting with a slip fit. This is used in combination with the aforementioned counterweight associated with the indicia carrying means to prevent the indicia carrying means from rotating. The indicia carrying means is preferably in the form of a disk or the like viewable at the central front of the minute housing.

BRIEF DESCRIPTION OF THE DRAWINGS

Numerous other objects, features and advantages of the invention should now become apparent upon a reading of the following detailed description taken in conjunction with the accompanying drawing, in which.

DETAILED DESCRIPTION

Figure 5:
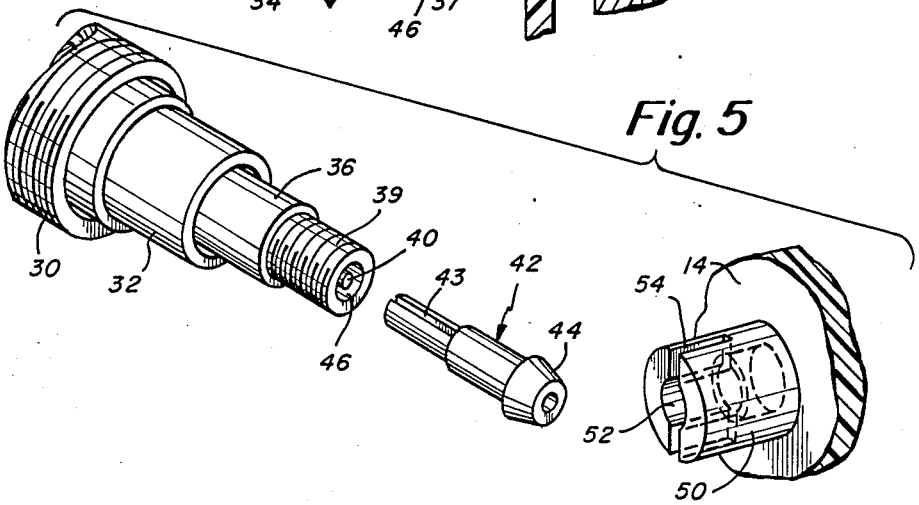
FIG. 5 is an exploded perspective view showing the parts illustrated in detail in the cross-sectional view of FIG. 4.
Figure 6:
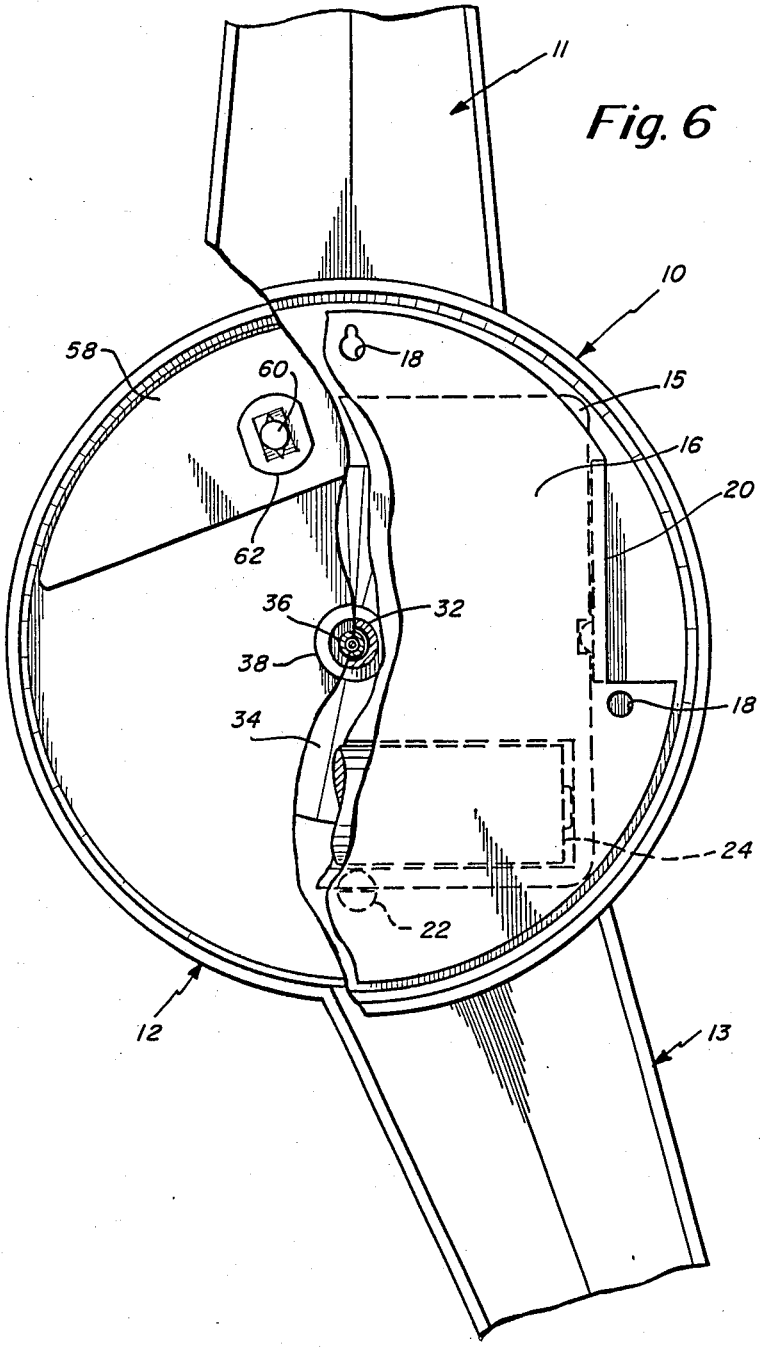
FIG. 6 is a rear view of the clock illustrated in FIGS. 1-5 partially cut away to show further internal details.
Figure 7:
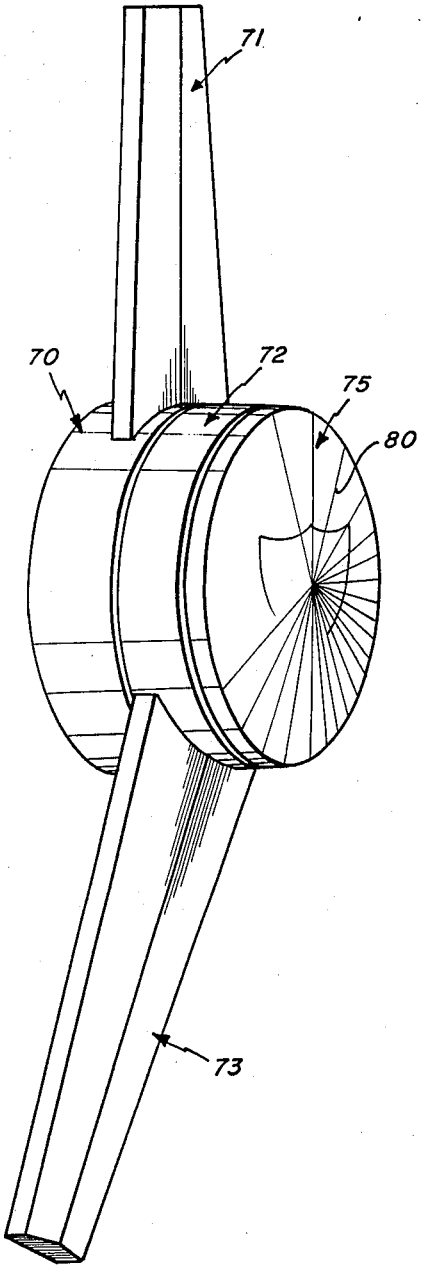
FIG. 7 is a perspective view of a second embodiment of the present invention.
Figure 8:
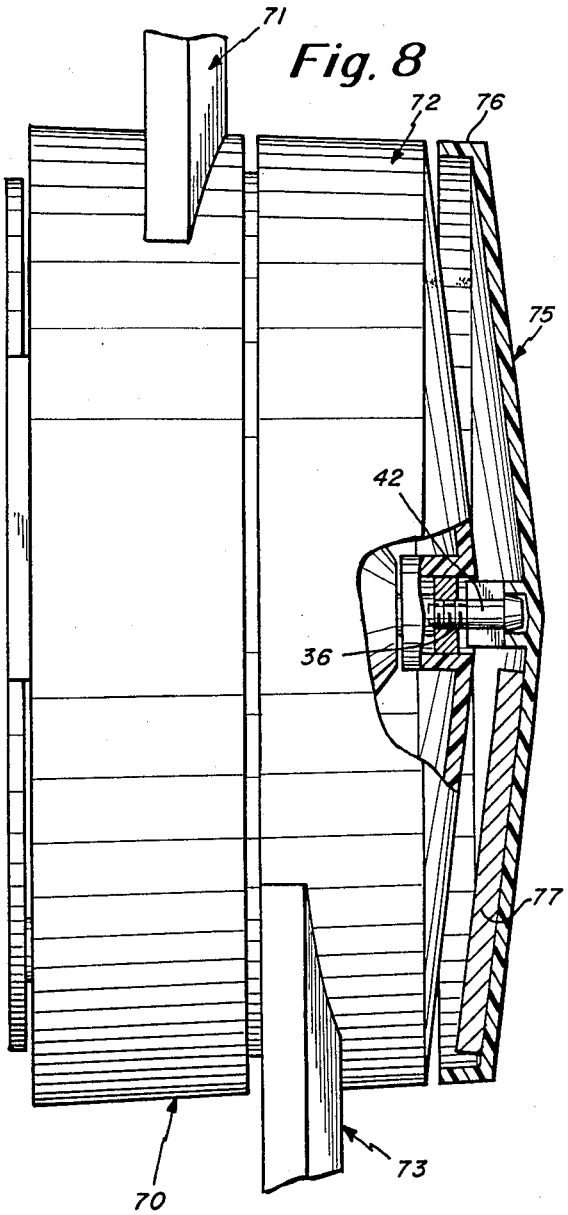
FIG. 8 is a side elevation view of the clock illustrated in FIG. 7 partially cut away to show in particular, the different form of the logo disk.

Reference is now made to the drawings which illustrate in detail a first embodiment of the invention in FIGS. 1-6 and a slightly different alternate embodiment of the invention illustrated in FIGS. 7 and 8. Basically the same structure is employed in both embodiments. However, in the second embodiment, the logo disk is of conical shape face whereas in the first embodiment it is of substantially flat plate-like face.

Figure 1:
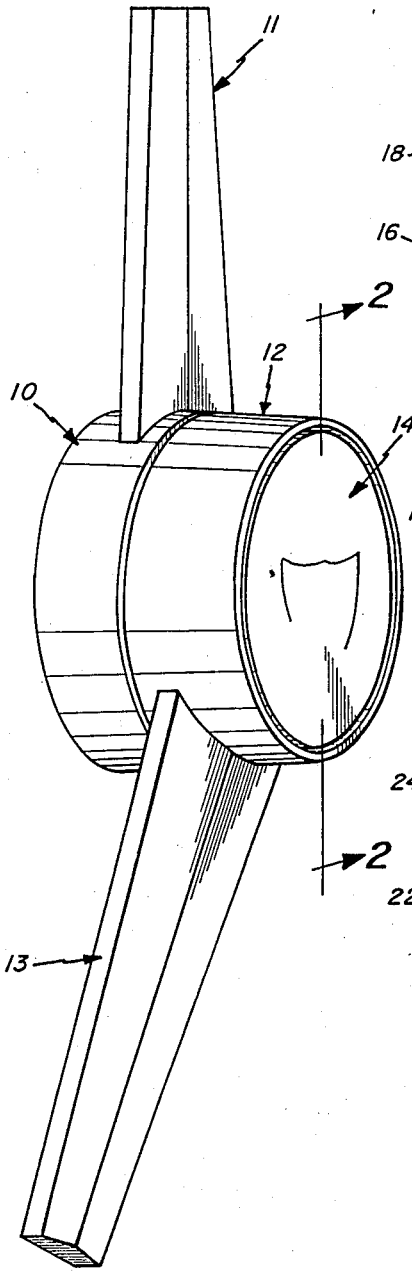
FIG. 1 is a perspective view of a clock in one embodiment constructed in accordance with the principles of the present invention.

FIG. 1 illustrates a perspective view of the clock of the present invention which may be referred to as a logo clock in that it functions as a clock primarily, but also has a front face with indicia thereon that may be in the form of a logo and that is maintained stationary. The clock comprises an hour housing 10 that supports an hour hand 11 integral therewith. Similarly, there is provided forward of the hour housing, a minute housing 12 that is of substantially the same diameter as the hour housing and that supports a minute hand 13 integral therewith.

FIG. 1 also illustrates at the front of the clock, disposed essentially at the front of the minute housing 12, a logo disk 14. This disk, in accordance with the invention, is adapted to be maintained in a stationary position relative to the adjacent rotating housing 12. The main purpose of the logo disk 14 is to have indicia thereon that could be in the form of a logo, slogan, trademark or other indicia or advertising.

Within the hour housing 10 there is provided the timing mechanism 15 that is supported by a support bracket 16. As noted in FIG. 6, the rear plate of the support bracket 16 is provided with a series of holes 18 that enable mounting of the bracket 16 to a wall or the like. In accordance with the embodiment that is illustrated, the timing mechanism 15 is maintained in a stationary position and the output drive shafts therefrom, which are explained in further detail hereinafter, are adapted to drive the respective housings 10 and 12 and in turn the corresponding clock hands 11 and 13. The bracket 16 is also provided with side pieces 20 and a bottom support post 22 which properly hold and position the timing mechanism 15. As illustrated in the drawing, there is also provided a battery 24 supported above the post 22 in a compartment adjacent the timing mechanism. The timing mechanism is operated from the battery 24.

The timing mechanism 15 is of conventional design and is indicated as battery operated. This mechanism has multiple output shafts driven at different timed speeds for providing proper timing for driving hour and minute hands.

Figure 2:
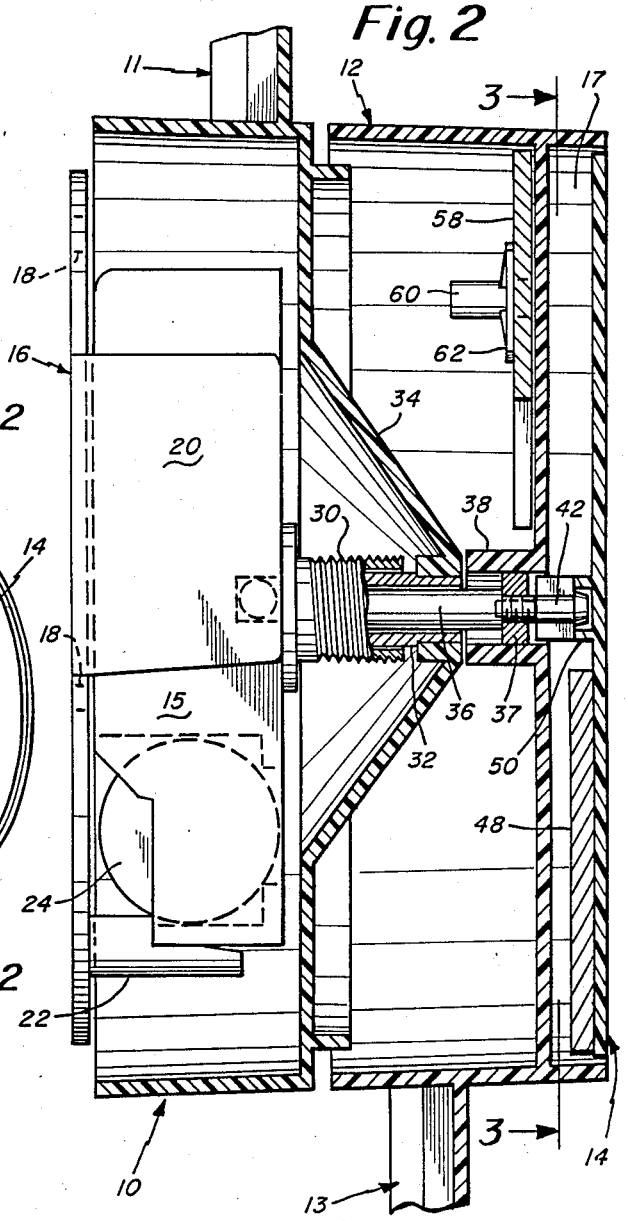
FIG. 2 is a cross-sectional view through the clock construction as taken along line 2—2 of FIG. 1.

Extending outwardly from the timing mechanism 15 as illustrated in the cross-sectional view of FIG. 2 is a support collar 30 that is externally threaded. The collar 30 is stationary and supports inside of it a series of concentric shafts including the hour shaft 32 which, as noted in FIG. 2, has a stepped end. The very end of the shaft 32 may even be slightly tapered, so as to receive the hole in the conical section 34 of the hour housing 10 in a force-fit engagement. In this way, when the shaft 32 is driven from the timing mechanism at the slow hour rate, the housing 10 is also driven at the hour rate as is the associated hand 11.

Concentric with and inside of the hour shaft 32 is a minute shaft 36 which is driven at a faster rate than the hour shaft of course, so as to provide minute housing rotation at a minute rate and of course corresponding minute hand rotation.

Figure 4:
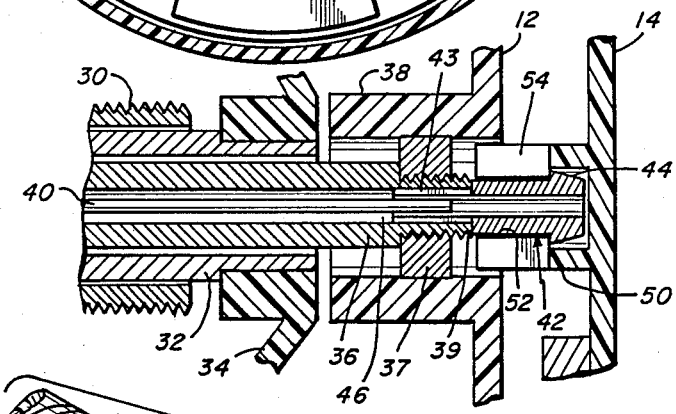
FIG. 4 is a cross-sectional view taken along line 4—4 of FIG. 3 showing further specific details of the clock construction.

The minute shaft 36 is threaded at the end and engages with a nut 37 fixedly supported in the support collar 38 at the center of the minute housing 12. In this regard, refer also to FIGS. 4 and 5 which show further details. For example, FIG. 5 shows the threaded end 39 of the shaft 36. FIG. 4 also shows a second drive shaft 40. It is noted that in the embodiment described herein, this shaft is driven, but does not in turn drive anything further.

The minute housing 12 is supported on the minute shaft by being screwed by way of the nut 37 onto the threaded end 39 of the shaft 36. Although not illustrated in the drawing, some kind of a lock member may be used to make sure that the housing 12 stays in a fixed position on the shaft 36.

Now, as previously indicated, there is provided at the very front of the clock, a logo disk 14, which in the embodiment of FIG. 1 is recessed in a front compartment 15 of the housing 12. The housing 12, of course, is driven at a minute rate, but the logo disk 14 is adapted to be maintained stationary. The logo disk 14 is supported in the manner illustrated in FIGS. 4 and 5. For this purpose, there is provided a support post 42 having a split end 43 and a truncated conical end 44. The post 42 is forcibly inserted into the bore 46 in which is supported the second shaft 40. It is noted, from FIG. 4, that the split end 43 of the post 42 has a larger inner diameter than the outer diameter of the shaft 40 so that there is no interference therebetween. Thus, the post 42 is fixedly secured to the shaft 36 and rotates therewith.

Figure 3:
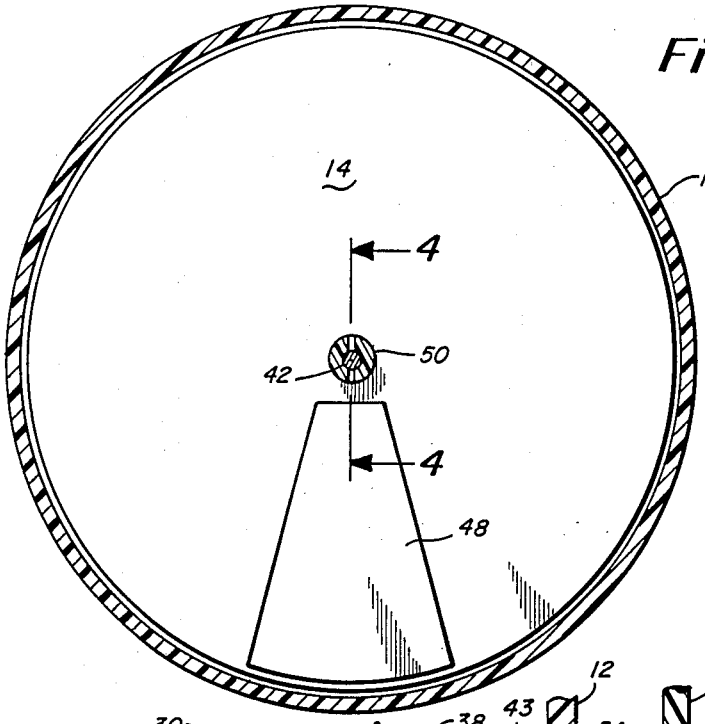
FIG. 3 is a further cross-sectional view taken along line 3—3 of FIG. 2 showing the counterweight that is used in the logo disk for maintaining it stationary.

Now, there are two techniques that are used to prevent rotation of the logo disk 14. First, there is a slip-fit provided between the logo disk and the support post 40. Second, there is provided a counterweight 48 which is illustrated in FIGS. 2 and 3. The counterweight 48 prevents the logo disk from rotating. Also, there is a slip-fit that is provided in the following manner. At the rear of the logo disk 14, there is provided a post 50 having a stepped bore 52 and a cross-slot 54. The post 42 may be metallic and the post 50 may be of Teflon so that there is a good sliding surface between these members. The post 42 is forced into the bore 52 and is interlocked therewith by means of an interlocking of the truncated cone end 44 of the post with the stepped shoulder of the bore 52. FIG. 4 illustrates the final position in which the post 42 is interlocked with the logo disk 14, but there is a slip-fit therebetween. Thus, as the post 42 is driven from the shaft 36, and furthermore with the use of the counterweight 48, the logo disk 14 does not rotate therewith. Instead, there is essentially relative rotation between the post 42 and the logo disk. The logo disk is maintained in an upright stationary position so that any indicia thereon is always maintained in an upright proper viewing position.

There is also preferably provided a further counterweight 58 inside of the minute housing 12. The counterweight 58 is illustrated in FIGS. 2 and 6. The counterweight has a hole that is received by the post 60. The post 60 is integral with the minute housing 12 on the inside thereof as illustrated in FIG. 2. A snap fastener 62 may also be used to assure that the counterweight 58 is held in a fixed peripheral position as illustrated in FIG. 6. The counterweight within the housing 12 is disposed, as noted in FIG. 2 in a direction opposite to the hand 13 so as to provide a balancing of the entire assembly of housing and hand. This makes the drive forces on the minute housing smaller than if the counterweight were not used. This assists in more smooth driving of the minute hand and prevents any over driving or burn out of the minute shaft from laboring in driving the minute housing and corresponding minute hand.

Reference is also made to the second embodiment of the invention illustrated in FIGS. 7 and 8. The mechanical structure in FIGS. 7 and 8 is substantially identical to that described in connection with FIGS. 1–6. However, the minute housing and the logo disk are of slightly different construction as will now be discussed.

In the embodiment of FIGS. 7 and 8, there is provided an hour housing 70 and associated hour hand 71. There is also provided a minute housing 72 and associated minute hand 73. In this second embodiment, rather than recessing the logo disk as in the first embodiment, there is provided an outwardly extending logo disk 75 that has a wide conical shape along with peripheral wall 76. In this embodiment of the invention, it is noted that the logo disk is secured in the same manner as in the first embodiment and thus in this connection, there is provided a support post 42 adapted to fit inside of the board minute shaft 36. Also note in the second embodiment, the use of a counterweight 77 inside of the conical logo disk. Again, a logo or the like indicia is provided on the face 80 of the disk. This face is maintained in an upright position as in the first embodiment by the combined use of the counterweight and the slippage provided between the driven post 42 and the board support post at the rear of the logo disk.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A clock comprising;

an hour housing supporting an hour hand integral therewith, a minute housing supporting a minute hand integral therewith, a timing mechanism and means supporting the timing mechanism in one of said housings at the rear of the clock, said timing mechanism having hour driven shaft means coupled to said hour housing for rotatably driving said hour housing and in turn said hour hand, and minute driven shaft means coupled to said minute housing for rotatably driving said minute housing and in turn said minute hand, means on one of said minute or hour housings for carrying indicia, means for maintaining the indicia carrying means in a stationary position relative to the adjacent rotating housing, and means for supporting the timing mechanism in a fixed position.

2. A clock as set forth in claim 1 including a counterweight disposed inside the minute housing along a peripheral side opposite to the minute hand.

3. A clock as set forth in claim 2 wherein said means for maintaining the indicia carrying means in a stationary position includes a second counterweight.

4. A clock as set forth in claim 1 wherein said timing mechanism is battery-operated and is disposed in the rear hour housing.

5. A clock as set forth in claim 4 wherein said indicia carrying means is disposed in front of the minute housing.

6. A clock as set forth in claim 5 wherein said means for maintaining the indicia carrying means in a stationary position includes means for supporting the indicia carrying means from the minute driven shaft means.

7. A clock as set forth in claim 6 wherein the means for supporting the indicia carrying means includes means for supporting with a slip-fit.

8. A clock as set forth in claim 7 including a counterweight in said indicia carrying means to prevent said indicia carrying means from rotating.

9. A clock as set forth in claim 1 wherein said means for maintaining the indicia carrying means in a stationary position includes means for supporting the indicia carrying means from the minute driven shaft means.

10. A clock as set forth in claim 9 wherein the means for supporting the indicia carrying means includes means for supporting with a slip-fit.

11. A clock as set forth in claim 10 including a counterweight in said indicia carrying means to prevent said indicia carrying means from rotating.

12. A clock as set forth in claim 1 wherein said means for maintaining the indicia carrying means in a stationary position includes a support post engaged with said minute driven shaft means and means on said indicia carrying means for freely rotatably engaging with said support post.

13. A clock as set forth in claim 12 wherein said indicia carrying means includes a disk viewable at the central front of the minute housing.

14. A clock as set forth in claim 13 wherein said means for freely rotatably engaging includes a slotted receiving port engageable with the support post.

15. A clock as set forth in claim 14 wherein said support post has a conical truncated end received in said slotted receiving port.

16. A clock comprising;

an hour hand and associated hour hand support means, a minute hand and associated minute hand support means, a timing means associated with said support means and having hour driven means for rotating said hour hand and minute driven means for rotating said minute hand, means on one of said hour or minute hand supporting means for carrying indicia, means for maintaining the indicia carrying means in a stationary position relative to the rotating hour and minute hands, and means for supporting the timing means in a fixed position.

17. A clock as set forth in claim 16 including a counterweight disposed inside the minute hand support means along a peripheral side opposite to the minute hand.

18. A clock as set forth in claim 17 wherein said means for maintaining the indicia carrying means in a stationary position includes a second counterweight.

19. A clock as set forth in claim 16 wherein said hour hand support means includes an hour housing and said minute hand support means includes a minute housing and wherein said indicia carrying means is disposed on front of the minute housing.

20. A clock as set forth in claim 19 wherein said hour driven means includes an hour driven shaft means and said minute driven means includes a minute driven shaft means, said indicia carrying means being supported from the minute driven shaft means and further including a counterweight in said indicia carrying means to prevent said indicia carrying means from rotating as said minute driven shaft means rotates.

21. A clock as set forth in claim 16 wherein said means for maintaining the indicia carrying means in a stationary position includes a support post engaged with said minute driven means and means on said indicia carrying means for freely rotatably engaging with said support post.

* * * * *